US011180288B2

(12) United States Patent
Shimada et al.

(10) Patent No.: US 11,180,288 B2
(45) Date of Patent: Nov. 23, 2021

(54) SYNTHETIC RESIN CONTAINER LID

(71) Applicant: NIPPON CLOSURES CO., LTD., Tokyo (JP)

(72) Inventors: Satoru Shimada, Kanagawa (JP); Hiroaki Hayashi, Kanagawa (JP); Takashi Sugiyama, Kanagawa (JP); Jun Wakishima, Kanagawa (JP); Go Oota, Kanagawa (JP); Yusuke Tani, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 167 days.

(21) Appl. No.: 16/488,184

(22) PCT Filed: Feb. 1, 2018

(86) PCT No.: PCT/JP2018/003433
§ 371 (c)(1),
(2) Date: Aug. 22, 2019

(87) PCT Pub. No.: WO2018/168242
PCT Pub. Date: Sep. 20, 2018

(65) Prior Publication Data

US 2020/0385178 A1 Dec. 10, 2020

(30) Foreign Application Priority Data

Mar. 13, 2017 (JP) ..... JP2017-046982

(51) Int. Cl.
*B65D 41/34* (2006.01)
*B65D 47/10* (2006.01)
(Continued)

(52) U.S. Cl.
CPC ..... *B65D 41/3447* (2013.01); *B65D 47/106* (2013.01); *B65D 47/123* (2013.01);
(Continued)

(58) Field of Classification Search
CPC .. B65D 41/3409; B65D 50/046; B65D 45/12; B65D 41/0457; B65D 41/04;
(Continued)

(56) References Cited

U.S. PATENT DOCUMENTS 3,434,613 A 3/1969 Langecker
4,197,960 A * 4/1980 Walter ..... B65D 41/0414 215/252
(Continued)

FOREIGN PATENT DOCUMENTS

JP 11-165756 6/1999
JP 2000-219259 8/2000
(Continued)

OTHER PUBLICATIONS

European Extended Search Report for Application No. 18768403.0 dated Apr. 17, 2020.

*Primary Examiner* — Kareen K Thomas
(74) *Attorney, Agent, or Firm* — Smith, Gambrell & Russell, LLP.

(57) ABSTRACT

A container lid (2) can be removed from a mouth-neck section (106) of a container without the need for a tool. Following the breakage of a breakable thin-walled line (70) in a transition region (52), the breakage of a breakable thin-walled connection wall (68) in a side wall separation region (54) can be started sufficiently smoothly in the container lid (2). For this purpose, the breakable thin-walled line (70) formed in a side wall (10) in the transition region (52) is brought into a form in which at least a part thereof extends obliquely downwardly in a counterclockwise direction.

10 Claims, 7 Drawing Sheets

(51) Int. Cl.
*B65D 47/12* (2006.01)
*B65D 51/22* (2006.01)

(52) U.S. Cl.
CPC ..... *B65D 51/22* (2013.01); *B65D 2401/35* (2020.05); *B65D 2565/385* (2013.01)

(58) Field of Classification Search
CPC ..... B65D 51/1688; B65D 50/068; B65D 41/3438; B65D 41/3428; B65D 41/3419; B65D 41/3442; B65D 41/3447; B65D 47/106; B65D 47/123; B65D 51/22; B65D 2401/35; B65D 2565/385; B65D 41/48
See application file for complete search history.

(56) References Cited

U.S. PATENT DOCUMENTS 4,874,101 A * 10/1989 Zalut ..... B65D 51/18 215/251
5,104,008 A * 4/1992 Crisci ..... B65D 47/243 222/153.07
5,507,416 A * 4/1996 Rapchak ..... B65D 41/48 222/153.07
5,588,545 A * 12/1996 King ..... B65D 41/0414 215/216
5,657,906 A * 8/1997 Rapchak ..... B65D 41/48 222/153.07
5,662,247 A * 9/1997 Rapchak ..... B65D 47/243 222/153.07
6,050,452 A * 4/2000 Pradinas ..... B65D 41/32 222/153.02
6,758,359 B2 * 7/2004 Yurkewicz ..... B65D 47/243 215/251
8,225,949 B2 * 7/2012 Aneas ..... B65D 51/241 215/249
8,235,232 B2 * 8/2012 Isogai ..... B65D 47/106 215/48
8,469,213 B2 * 6/2013 Ishii ..... B65D 55/16 215/252
8,857,638 B2 * 10/2014 Brozell ..... B65D 50/041 215/220
2010/0219186 A1 * 9/2010 Kuwagaki ..... B65D 47/0838 220/256.1

FOREIGN PATENT DOCUMENTS

JP 2004-90969 3/2004
JP 2009-4427237 12/2009
JP 2010-52773 3/2010

* cited by examiner

SYNTHETIC RESIN CONTAINER LID

TECHNICAL FIELD

This invention relates to a synthetic resin container lid including a side wall and a surrounding wall surrounding the side wall. More specifically, the invention relates to a synthetic resin container lid which is mounted on a mouth-neck section of a container by engaging a locking means formed on the inner peripheral surface of the side wall with a locking jaw portion formed on the outer peripheral surface of the mouth-neck section of the container, but can be removed sufficiently easily from the mouth-neck section of the container without using a tool.

BACKGROUND ART

Patent Document 1 to be indicated below discloses a synthetic resin container lid suitable for application to a mouth-neck section of a container for a liquid seasoning. The synthetic resin container lid includes a main portion for covering the top face of the mouth-neck section of the container, a cylindrical side wall suspending from the main portion, and a cylindrical surrounding wall surrounding the side wall. A locking means extending in a circumferential direction is formed on the inner peripheral surface of the side wall. By fitting the synthetic resin container lid onto the mouth-neck section of the container to engage the locking means with a locking jaw portion formed on the outer peripheral surface of the mouth-neck section of the container, the synthetic resin container lid is mounted on the mouth-neck section of the container. A surrounding wall separation region, a transition region, and a side wall separation region are disposed sequentially counterclockwise as viewed from above. In the surrounding wall separation region, the upper end of the surrounding wall is connected to the side wall via a plurality of breakable connecting pieces arranged at intervals in the circumferential direction or via a breakable thin-walled connecting wall extending continuously in the circumferential direction. At the counterclockwise upstream end of the surrounding wall separation region, a slit extending upwardly from the lower end is formed in the surrounding wall. In the transition region, a breakable thin-walled line extending vertically is formed in the side wall, and the side wall and the surrounding wall are firmly connected together on a side counterclockwise downstream of the breakable thin-walled line. In the side wall separation region, the upper end of the side wall is connected to the main portion via the breakable thin-walled connecting wall extending continuously in the circumferential direction.

In removing the container lid from the mouth-neck section for so-called sorted collection of wastes after the contents of the container are consumed, the first step is to break, in the surrounding wall separation region, the plurality of breakable connecting pieces or the breakable thin-walled connecting wall in the counterclockwise direction from the upstream end thereof to separate the surrounding wall from the side wall. Then, in the transition region, the breakable thin-walled line of the side wall is broken. In the side wall separation region, moreover, the breakable thin-walled connecting wall is broken in the counterclockwise direction from the upstream end of the side wall separation region to separate the side wall from the main portion. As a result, the locking means formed on the inner peripheral surface of the side wall is spaced at least partially from the locking jaw portion formed in the mouth-neck section of the container. Hence, the entire container lid can be removed from the mouth-neck section of the container without the need for a tool.

PRIOR ART DOCUMENTS

Patent Documents

Patent Document 1: Japanese Patent No. 4427237

SUMMARY OF THE INVENTION

Problems to be Solved by the Invention

The above-described container lid can be removed as a whole from the mouth-neck section of the container without the use of a tool. According to the present inventors' experiences, however, this container lid still has the following problems unresolved: When the breakage of the breakable thin-walled line of the side wall is performed in the transition region and the breakage of the breakable thin-walled connecting wall is started in the counterclockwise direction in the side wall separation region, it is difficult to start the breakage of the breakable thin-walled connecting wall simultaneously with or subsequently to the breakage of the breakable thin-walled line of the side wall, because the breakage of the breakable thin-walled line of the side wall takes place in the vertical direction, whereas the breakage of the breakable thin-walled connecting wall is performed in the circumferential direction. Consequently, the container lid cannot be removed sufficiently easily from the mouth-neck section of the container.

The present invention has been accomplished in the light of the above facts. Its main technical challenge is to solve the foregoing problems remaining in conventional container lids, and provide a novel and improved container lid which can be removed sufficiently easily from the mouth-neck section of a container.

Means for Solving the Problems

As a result of in-depth studies and experiments, the present inventors have found that the breakage of the breakable thin-walled connecting wall in the side wall separation region can be started sufficiently smoothly following the breakage of the breakable thin-walled line in the transition region, if the breakable thin-walled line formed in the side wall in the transition region is brought into a form in which at least a part thereof extends obliquely downwardly in a counterclockwise direction. Thus, the container lid can be removed sufficiently easily from the mouth-neck section of the container.

That is, according to the present invention, there is provided, as a container lid capable of solving the aforementioned main technical challenge, a synthetic resin container lid having a lid body, and being configured such that the lid body includes a main portion for covering a top face of a mouth-neck section of a container, a cylindrical side wall suspending from the main portion, and a cylindrical surrounding wall surrounding the side wall, locking means extending in a circumferential direction is formed on an inner peripheral surface of the side wall, and the lid body is fitted onto the mouth-neck section of the container to engage the locking means with a locking jaw portion formed on an outer peripheral surface of the mouth-neck section of the container, whereby the lid body is mounted on the mouth-neck section of the container, wherein a surrounding wall separation region, a transition region, and a side wall separation region are disposed sequentially in the counterclockwise direction as viewed from above, in the surrounding wall separation region, an upper end of the surrounding wall is connected to the side wall via a plurality of breakable connecting pieces arranged at intervals in the circumferential direction or via a breakable thin-walled connecting wall extending continuously in the circumferential direction and, at a counterclockwise upstream end of the surrounding wall separation region, a slit extending upwardly from a lower end of the surrounding wall is formed in the surrounding wall, in the transition region and the side wall separation region, an upper end of the side wall is connected to the main portion via a breakable thin-walled connection wall extending continuously in the circumferential direction, and in the transition region, moreover, a breakable thin-walled line at least a part of which extends obliquely downwardly in the counterclockwise direction is formed in the side wall, and the side wall and the surrounding wall are firmly connected together on a side counterclockwise downstream of the breakable thin-walled line.

Preferably, the breakable thin-walled line formed in the side wall in the transition region is composed of an upper end portion extending vertically downwardly from the upper end of the side wall, and an inclined main portion following the upper end portion and extending obliquely downwardly to a lower end of the side wall in the counterclockwise direction. It is preferred for the inclined main portion to have an inclination angle of 10 to 80 degrees with respect to a vertical. Advantageously, the surrounding wall separation region is present over an angle of 20 to 180 degrees, the transition region is present over an angle of 10 to 45 degrees, and the side wall separation region is present over an angle of 90 to 270 degrees. Preferably, a non-separation region present over an angle of 45 to 180 degrees is present between the side wall separation region and the surrounding wall separation region. A counterclockwise upstream edge of the surrounding wall on a side counterclockwise downstream of the slit is desirably connected via a breakable connection piece to a counterclockwise downstream edge of the surrounding wall on a side counterclockwise upstream of the slit, or to the side wall. Preferably, in the transition region, a thin-walled portion, which is defined by locally increasing the inner diameter of the side wall and extends obliquely downwardly in the counterclockwise direction, is formed in the side wall, a region where the side wall and the surrounding wall are firmly connected together includes a part of the thin-walled portion, and the breakable thin-walled line is defined by a part in the thin-walled portion where the side wall and the surrounding wall are not connected together. The breakable thin-walled connection wall which connects the main portion and the side wall together in the side wall separation region is preferably defined by locally decreasing the outer diameter of a cylindrical connecting portion. In preferred embodiments, a discharge opening formation region demarcated by a breakable line is defined in the main portion, a cylindrical wall having an external thread formed on a cylindrical outer peripheral surface thereof is disposed in the main portion, and an outer lid having a top panel wall and a cylindrical suspending wall, which suspends from the top panel wall and has an internal thread formed on an inner peripheral surface thereof, is removably mounted on the lid body by screwing the internal thread to the external thread.

Effects of the Invention

In the container lid of the present invention, at least a part of the breakable thin-walled line formed in the side wall in the transition region extends obliquely downwardly in the counterclockwise direction. Thus, the breakage of the breakable thin-walled connecting wall in the side wall separation region can be started sufficiently smoothly following the breakage of the breakable thin-walled line in the transition region. Consequently, the container lid can be removed sufficiently easily from the mouth-neck section of the container.

MODE FOR CARRYING OUT THE INVENTION

The present invention will now be described in further detail by reference to the accompanying drawings illustrating a preferred embodiment of a container lid configured in accordance with the present invention.

Figure 1:
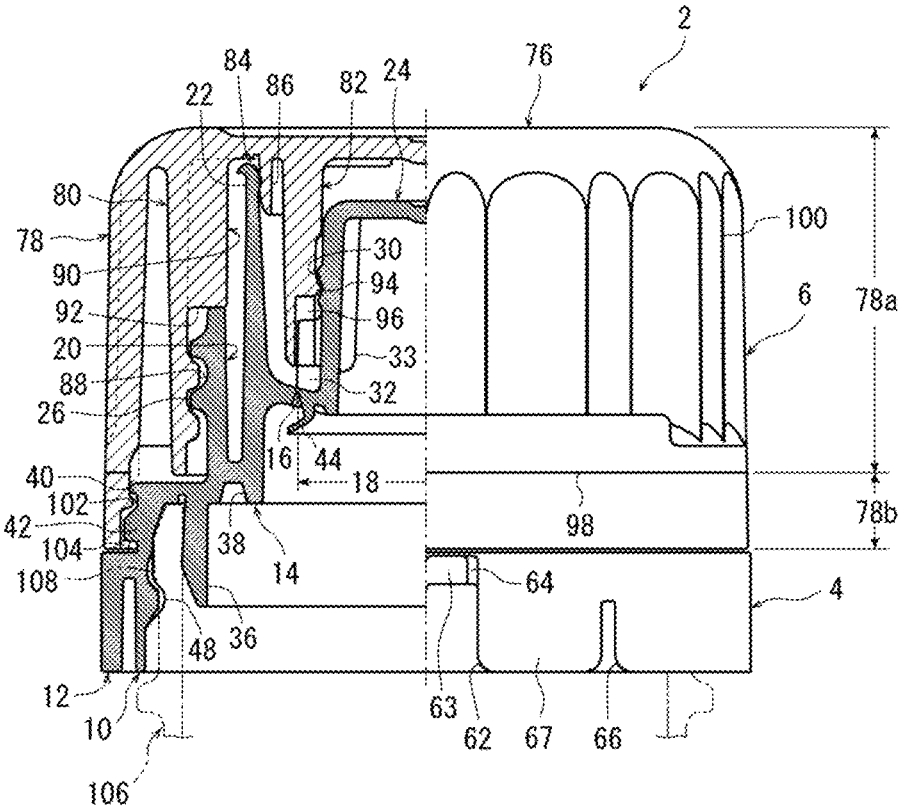
FIG. 1 is a front view, partly in cross section, of a preferred embodiment of a synthetic resin container lid configured in accordance with the present invention, with the synthetic resin container lid being mounted on a mouth-neck section of a container.

With reference to FIG. 1, a container lid entirely indicated at 2, which has been configured in accordance with the present invention, is constituted by a lid body 4 and an outer lid 6. The lid body 4 can be injection molded from a relatively flexible synthetic resin such as polyethylene, while the outer lid 6 can be injection molded from a relatively rigid synthetic resin such as high density polyethylene or polypropylene.

Figure 3:
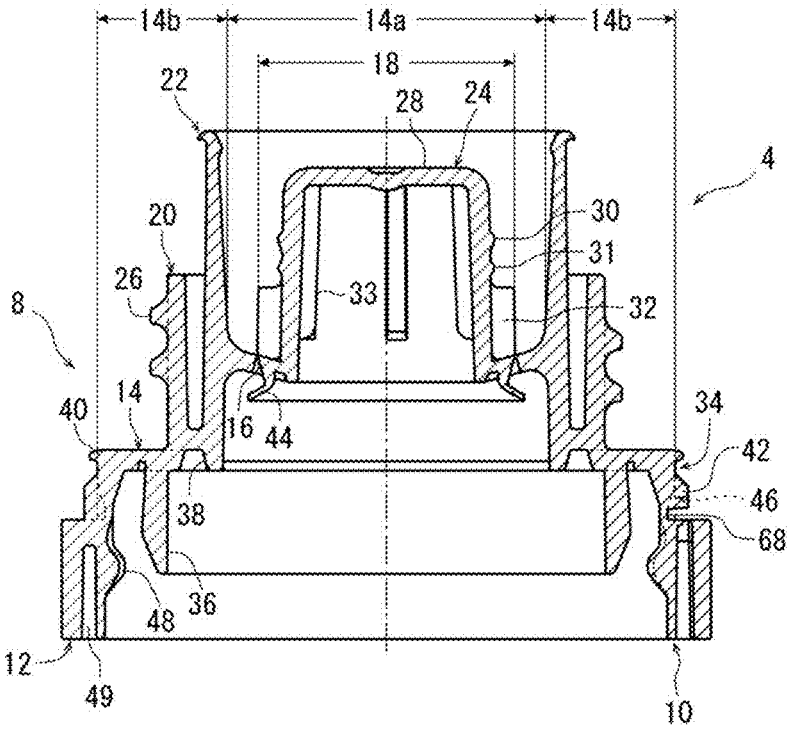
FIG. 3 is a sectional view of the lid body in the synthetic resin container lid shown in FIG. 1.

Mainly referring to FIG. 3, the lid body 4 includes a main portion 8, a cylindrical side wall 10 suspending from the main portion 8, and a cylindrical surrounding wall 12 surrounding the side wall 10. The main portion 8 has a closing wall 14, and the closing wall 14 is demarcated into a circular central region 14*a* located relatively above as viewed in the axial direction, and a toroidal outer peripheral region 14*b* located relatively below as viewed in the axial direction. The central region 14*a* of the closing wall 14 is provided with a circular discharge opening formation region 18 defined by a toroidal breakable line 16. On the upper surface of the closing wall 14, there are formed a cylindrical wall 20 extending out upwardly at a radially nearly middle position of the outer peripheral region 14*b*, a cylindrical pouring wall 22 extending out upwardly in a radially inner edge part of the outer peripheral region 14*b*, and a cylindrical locked wall 24 extending out upwardly in a central part of the central region 14*a* (more detailedly, the discharge opening formation region 18). On the outer peripheral surface of the cylindrical wall 20, an external thread 26 is formed. An upper end part of the pouring wall 22 is curled radially outwardly. The extending-out height of the pouring wall 22 is greater than the extending-out height of each of the cylindrical wall 20 and the locked wall 24. At the upper end of the locked wall 24, a substantially horizontal circular wall portion 28 is provided. In an axially nearly middle part of the outer peripheral surface of the locked wall 24, there are disposed a first locked ridge 30 extending continuously in the circumferential direction and protruding radially outwardly, and an auxiliary ridge 31 which lies somewhat below the first locked ridge 30, extends continuously in the circumferential direction, and protrudes radially outwardly. Below the auxiliary ridge 31 on the outer peripheral surface of the locked wall 24, a first circumferential locked means 32 is disposed. As will be understood by reference to FIG. 4 along with FIG. 3, in the illustrated embodiment, six of the first circumferential locked means 32 are arranged at circumferentially equal angular intervals. The first circumferential locked means 32 will be mentioned later. On the inner peripheral surface of the locked wall 24, four ribs 33 extending in the axial direction are formed at circumferentially equal angular intervals. The rib 33 makes it possible to restrain the rotation of the lid body 4 relative to the outer lid 6 in collaboration with a predetermined jig when the outer lid 6 is mounted on the lid body 4.

Figure 4:
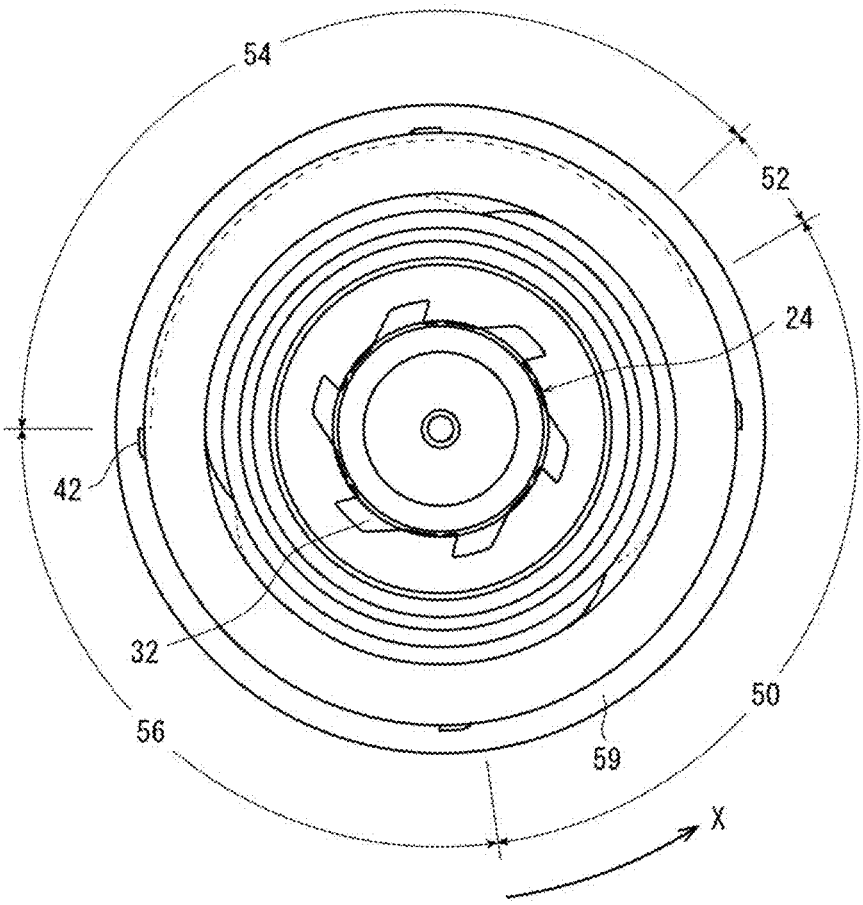
FIG. 4 is a plan view of the lid body in the synthetic resin container lid shown in FIG. 1.
Figure 5:
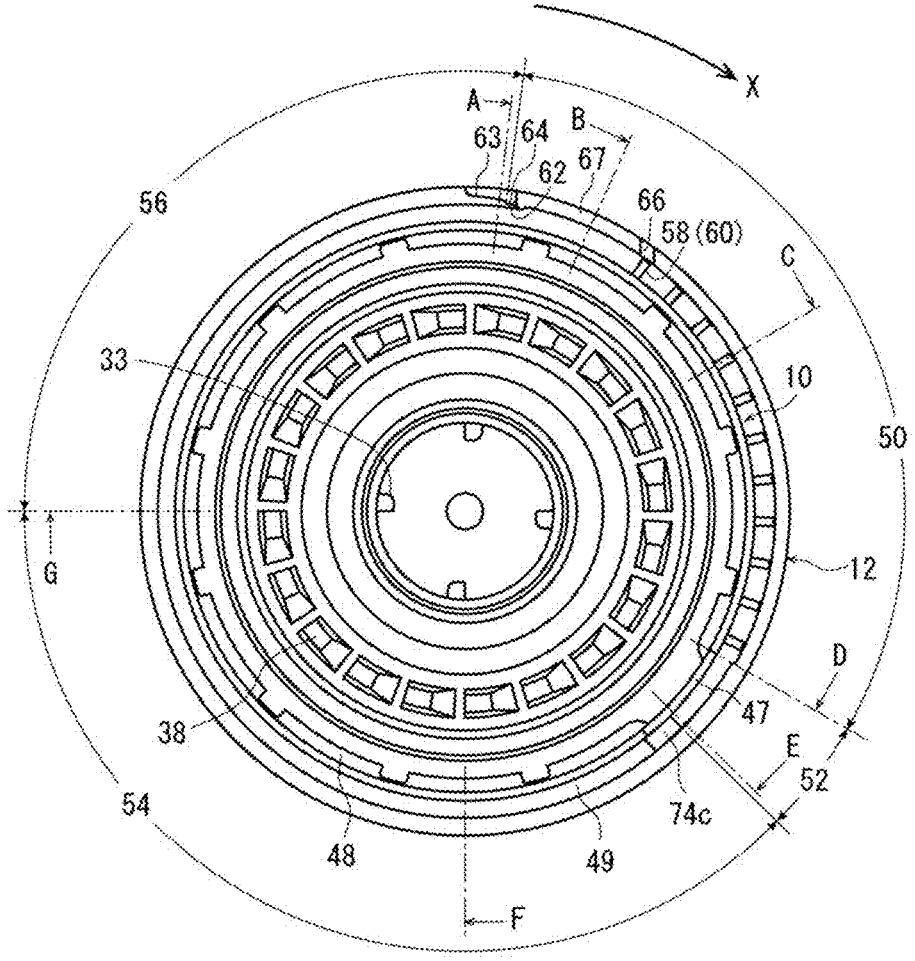
FIG. 5 is a bottom view of the lid body in the synthetic resin container lid shown in FIG. 1.

By further reference to FIGS. 3 to 5, the outer peripheral region 14*b* in the lower surface of the closing wall 14 is formed with a cylindrical suspending wall 34 suspending from the outer peripheral edge thereof, an annular sealing wall 36 extending out downwardly at a radially nearly middle position thereof, and a ratchet portion 38 (refer to FIG. 5, in particular) located in a radially inward end part thereof. In an upper end part of the outer peripheral surface of the suspending wall 34, a second locked ridge 40 is disposed which extends continuously in the circumferential direction and protrudes outwardly in the radial direction. In a lower end part of the outer peripheral surface of the suspending wall 34, a second circumferential locked means 42 is disposed. As clearly illustrated in FIG. 4, in the illustrated embodiment, four of the second circumferential locked means 42 are arranged at equal angular intervals in the circumferential direction. The second circumferential locked means 42 will be mentioned later. The ratchet portion 38 is in a configuration well known per se, and makes it possible to restrain the rotation of the lid body 4 relative to the outer lid 6 in collaboration with a predetermined jig when the outer lid 6 is mounted on the lid body 4 (see JP-A-2008-273531). In the central region 14*a* of the lower surface of the closing wall 14, an annular sealing piece 44 is also formed. The annular sealing piece 44 has a base end which is connected to the lower surface of the closing wall 14 radially inwardly of the breakable line 16, and the annular sealing piece 44 extends out from the base end obliquely downwardly toward a radial outside, such that the extending-out end of the annular sealing piece 44 is located radially outwardly of the breakable line 16. The sealing piece 44 is relatively thin-walled and can be elastically deformed.

Figure 10:
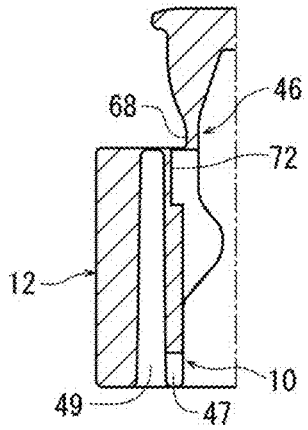
FIG. 10 is a partial sectional view of the lid body at an angular position indicated by D in FIGS. 4 and 5.
Figure 11:
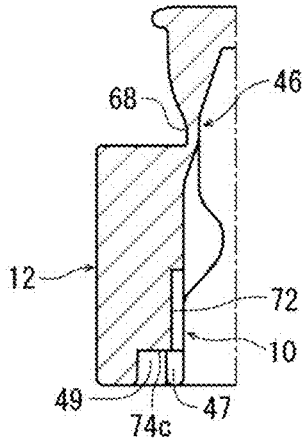
FIG. 11 is a partial sectional view of the lid body at an angular position indicated by E in FIGS. 4 and 5.

Mainly referring to FIGS. 3 and 5, the side wall 10 has an upper end connected to the lower end of the suspending wall 34 of the main portion 8 via a cylindrical connecting portion 46. In a circumferential predetermined region in a lower end part of the side wall 10, a rectangular notch 47 is provided (see FIGS. 10, 11 and 14 along with FIG. 5). On the inner peripheral surface of the side wall 10, a locking means 48 extending in the circumferential direction is formed. The illustrated embodiment shows the locking means 48 as a plurality of circumferentially extending ridges provided at intervals in the circumferential direction. The locking means 48 is not present in a part where a thin-walled portion to be described later is formed (see FIG. 14 along with FIG. 5). If desired, the locking means 48 may be a single ridge extending continuously in the circumferential direction, or a plurality of flap pieces provided at intervals in the circumferential direction. In either case, the locking means 48 is not present in the part where the thin-walled portion is formed.

As shown in FIG. 3, an annular gap 49 having no bottom is provided between the surrounding wall 12 and the side wall 10. Connection between the surrounding wall 12 and the side wall 10 will be mentioned later.

Further referring to FIGS. 4 and 5, it is important for the container lid according to the present invention that a surrounding wall separation region 50, a transition region 52, and a side wall separation region 54 be disposed sequentially in a counterclockwise direction (a direction indicated by an arrow X) as viewed from above. Preferably, a non-separation region 56 is present between the side wall separation region 54 and the surrounding wall separation region 50. It is advantageous that the surrounding wall separation region 50 be present over an angle of 20 to 180 degrees, the transition region 52 be present over an angle of 10 to 45 degrees, the side wall separation region be present over an angle of 90 to 270 degrees, and the non-separation region 56 be present over an angle of 45 to 180 degrees. In the illustrated embodiment, the surrounding wall separation region 50 has an angle of 125 degrees, the transition region 52 has an angle of 15 degrees, the side wall separation region 54 has an angle of 130 degrees, and the non-separation region 56 has an angle of 90 degrees.

Figure 2:
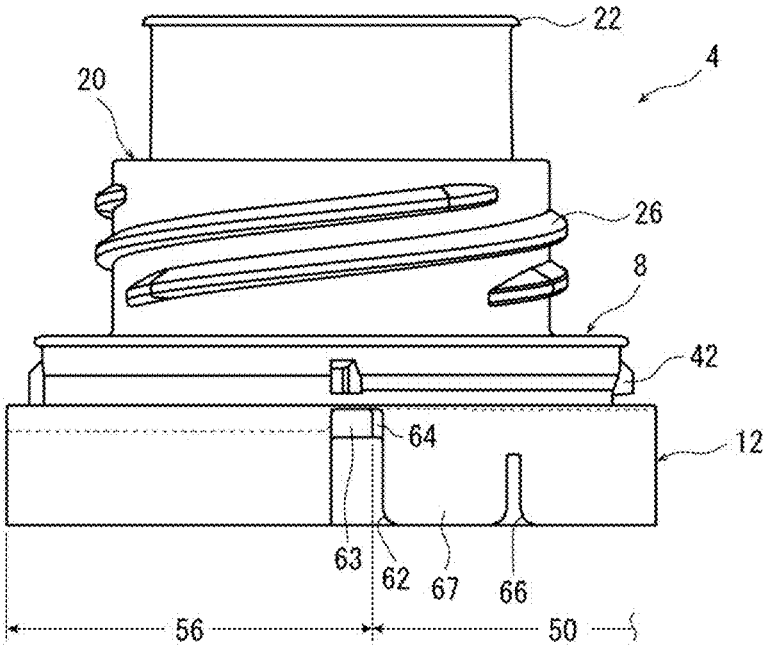
FIG. 2 is a front view of a lid body in the synthetic resin container lid shown in FIG. 1.
Figure 7:
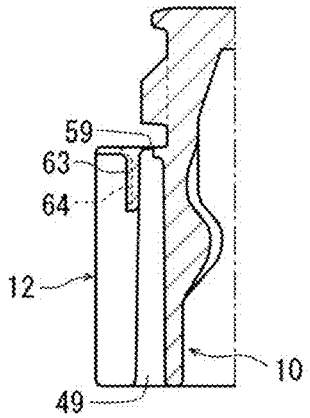
FIG. 7 is a partial sectional view of the lid body at an angular position indicated by A in FIGS. 4 and 5.
Figure 8:
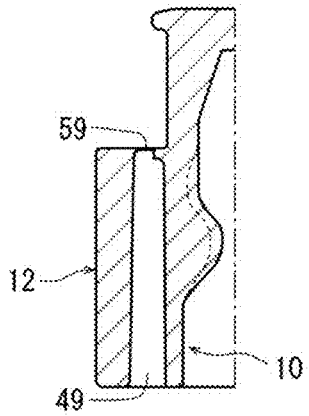
FIG. 8 is a partial sectional view of the lid body at an angular position indicated by B in FIGS. 4 and 5.
Figure 9:
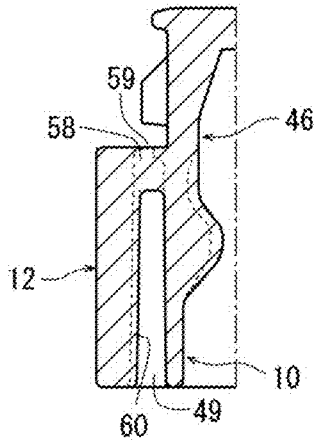
FIG. 9 is a partial sectional view of the lid body at an angular position indicated by C in FIGS. 4 and 5.

Mainly referring to FIGS. 4 and 5, in the surrounding wall separation region 50, the upper end of the surrounding wall 12 is connected to the side wall 10 via a plurality of breakable connecting pieces 58 arranged at intervals in the circumferential direction and a breakable thin-walled connecting wall 59 extending continuously in the circumferential direction (see FIGS. 7 to 9 as well). As will be understood by reference to FIG. 9, ribs 60 extending continuously in the axial direction from the upper end to the lower end of the inner peripheral surface of the surrounding wall 12 are formed in correspondence with the circumferential positions of the respective connecting pieces 58. Further referring to FIG. 2 along with FIGS. 4 and 5, a slit 62 extending upwardly from the lower end of the surrounding wall 12 is formed at the upstream end in the counterclockwise direction of the surrounding wall separation region 50. In the illustrated embodiment, a downstream end part in the counterclockwise direction of the non-separation region 56 in the surrounding wall 12 is notched in a nearly rectangular form, except a remaining portion 63 located in an upper end part thereof, and the remaining portion 63 is in a thin-walled form of an L-shaped cross section facing downward (see FIG. 7 as well). An upper end part of the counterclockwise upstream edge of the surrounding wall 12 on the side counterclockwise downstream of the slit 62 is connected via a breakable connection piece 64 to an upper end part of the counterclockwise downstream edge of the surrounding wall 12 on the side counterclockwise upstream of the slit 62, namely, to the remaining portion 63. As will be clearly understood by reference to FIGS. 5 and 7, the wall thickness of the breakable connection piece 64 is smaller than the wall-thickness of the thin-walled remaining portion 63 of the surrounding wall 12. Referring to FIGS. 2 and 5, on the side downstream of the slit 62 in the counterclockwise direction, an auxiliary slit 66 extending upwardly from the lower end of the surrounding wall 12 is formed, and a pinching portion 67 is defined between the slit 62 and the auxiliary slit 66 (neither the connecting piece 58 nor the rib 60 is formed in the pinching portion 67) as viewed in the counterclockwise direction. If desired, the upper end of the surrounding wall 12 may be connected to the side wall 10 via either the breakable connecting piece 58 or the breakable thin-walled connecting wall 59. An upper end part of the counterclockwise upstream edge of the surrounding wall 12 on the side counterclockwise downstream of the slit 62 may be connected to the side wall 10 via the breakable connection piece 64. Furthermore, the remaining portion 63 may be formed in a lower end part or a middle part of the surrounding wall 12 instead of being located in the upper end part of the surrounding wall 12 as viewed in the axial direction. If the remaining portion 63 is formed in the lower end part or the middle part of the surrounding wall 12 as viewed in the axial direction, it follows that the breakable connection piece 64, which connects the remaining portion 63 to the counterclockwise upstream edge of the surrounding wall 12 on the side counterclockwise downstream of the slit 62, is also located in the lower end part or the middle part of the surrounding wall 12 as viewed in the axial direction.

Figure 6:
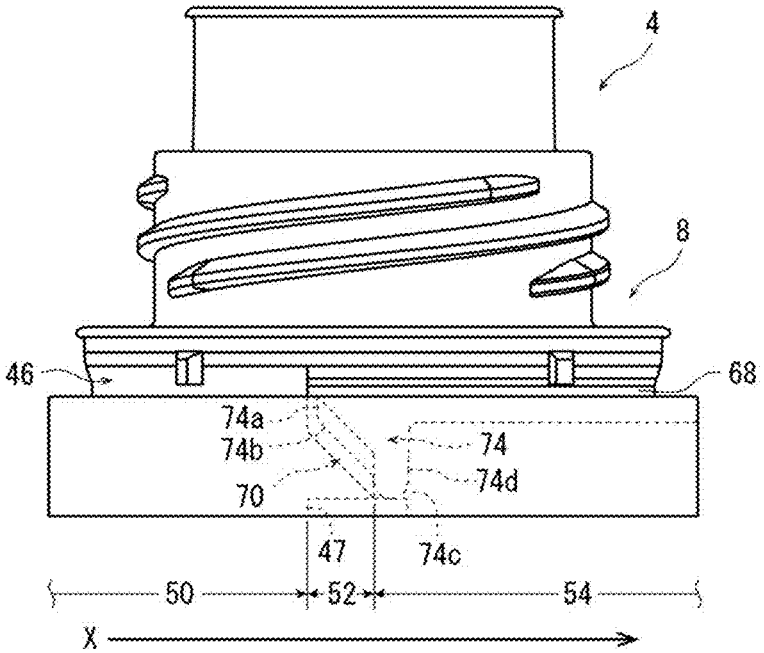
FIG. 6 is a side view of the lid body in the synthetic resin container lid shown in FIG. 1, with a transition region being located at the front position.

Mainly referring to FIGS. 5 and 6, in the transition region 52 and the side wall separation region 54, the upper end of the side wall 10 is connected to the main portion 8 via a breakable thin-walled connection wall 68 extending continuously in the circumferential direction. The breakable thin-walled connection wall 68 is defined by locally decreasing the outer diameter of the cylindrical connecting portion 46 (see FIG. 9 and FIGS. 10 to 12 by comparison with each other).

Figure 14:
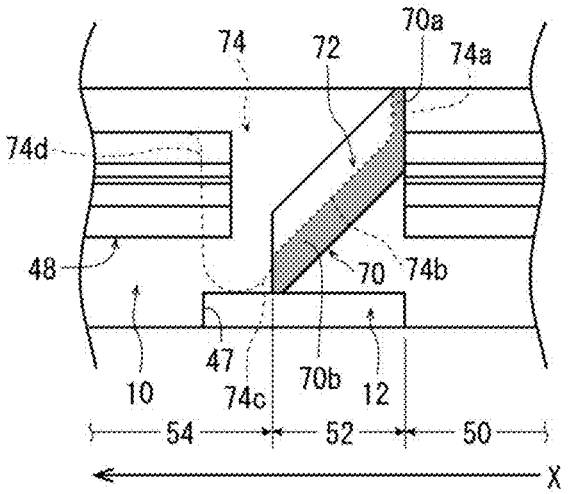
FIG. 14 is a partial schematic view showing a breakable thin-walled line formed in the synthetic resin container lid shown in FIG. 1.

With main reference to FIGS. 5, 6 and 14, it is further important in the transition region 52 that a breakable thin-walled line 70 at least a part of which extends obliquely downwardly in the counterclockwise direction be formed in the side wall 10, and that on the side downstream of the breakable thin-walled line 70 in the counterclockwise direction, the side wall 10 and the surrounding wall 12 be firmly connected together. In the illustrated embodiment, in the transition region 52, a thin-walled portion 72 which is defined by locally increasing the inner diameter of the side wall 10 and extends obliquely downwardly in the counterclockwise direction is formed in the side wall 10 (see FIGS. 10 and 11 as well). As will be clearly understood by reference to FIG. 14, the thin-walled portion 72 is in a nearly parallelogrammatic form, and the upper end of its counterclockwise upstream end aligns with the upper end of the side wall 10, while the lower end of its counterclockwise downstream end aligns with the lower end of the side wall 10 (see also FIGS. 10 and 11). A region 74 where the side wall 10 and the surrounding wall 12 are firmly connected together includes a part of the thin-walled portion 72, and the breakable thin-walled line 70 is defined by a part in the thin-walled portion 72 where the side wall 10 and the surrounding wall 12 are not connected together (a part indicated by a gray zone in FIG. 14).

The above region 74 will be described in further detail by reference to FIG. 14. The region 74 has, in the transition region 52, a first straight edge 74*a* extending vertically downwardly from the upper end of the side wall 10 up to an axially nearly middle position of the thin-walled portion 72 at a position slightly downstream of the counterclockwise upstream end of the transition region 52, and an inclined side edge 74*b* following the lower end of the first straight edge 74*a* and extending obliquely downwardly in the counterclockwise direction and parallel to the thin-walled portion 72. The region 74 also has, in a counterclockwise upstream end part of the side wall separation region 54, a U-shaped edge 74*c* following the counterclockwise downstream end of the inclined side edge 74*b*, crooked so as to become convex downwardly, and having an inflection point in alignment with the lower end of the side wall 10, and a second straight edge 74*d* following the upper end of the U-shaped edge 74*c* located downstream in the counterclockwise direction, and extending vertically upwardly up to the upper end position of the locking means 48 as viewed in the axial direction. The region 74 of the side wall 10 is more rigid than the thin-walled portion 72 of the side wall 10, thus making the thin-walled portion 72 easily breakable along the peripheral edge of the region 74 in the transition region 52. The breakable thin-walled line 70 is composed of an upper end portion 70*a* extending vertically downwardly from the upper end of the side wall 10 along the first straight edge 74*a* in the thin-walled portion 72, and an inclined main portion 70*b* following the upper end portion 70*a* and extending obliquely downwardly in the counterclockwise direction up to the lower end of the side wall 10 along the inclined edge 74*b*. The inclined main portion 70*b* preferably has an inclination angle of 10 to 80 degrees to a vertical and, in the illustrated embodiment, has an inclination angle of 45 degrees. If desired, the thin-walled portion 72, instead of being in the form of a parallelogram including a part of the region 74, may be in a form not including the region 74, but extending along the outer peripheries of its first straight edge 74*a*, inclined edge 74*b*, and U-shaped edge 74*c*. If the thin-walled portion is shaped into such a form, however, the shape of a mold for forming the thin-walled portion will be complicated, posing the possibility of making the manufacturing process complicated and increasing the manufacturing cost.

Figure 12:
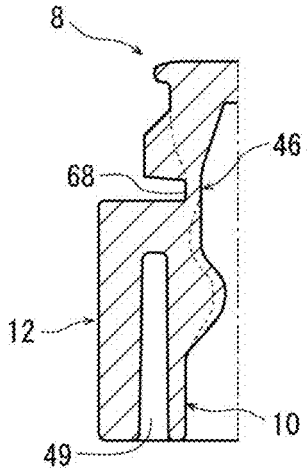
FIG. 12 is a partial sectional view of the lid body at an angular position indicated by F in FIGS. 4 and 5.
Figure 13:
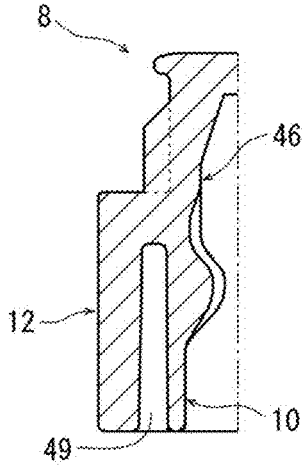
FIG. 13 is a partial sectional view of the lid body at an angular position indicated by G in FIGS. 4 and 5.

In the non-separation region 56, the side wall 10 and the surrounding wall 12 are firmly connected together, and the breakable thin-walled connecting wall is not formed in the connecting portion 46 connecting the main portion 8 and the side wall 10 (see FIGS. 12 and 13 in comparison with each other).

With reference to FIG. 1, the outer lid 6 has a circular top panel wall 76, and a cylindrical skirt wall 78 suspending downwardly from the outer peripheral edge of the top panel wall 76. On the inner surface of the top panel wall 76, there are formed a cylindrical suspending wall 80 suspending downwardly in an outer peripheral edge part thereof, and a cylindrical locking wall 82 suspending downwardly in a central region thereof. On the inner surface of the top panel wall 76, there are also formed a tubular liquid retaining piece 84 suspending downwardly between the suspending wall 80 and the locking wall 82 as viewed in the radial direction, and a tubular auxiliary sealing piece 86 suspending downwardly between the liquid retaining piece 84 and the locking wall 82 as viewed in the radial direction. In a lower end part of the inner peripheral surface of the suspending wall 80, an internal thread 88 is disposed. In an upper end part of the inner peripheral surface of the suspending wall 80, a plurality of protruding pieces 90 are formed at equal angular intervals in the circumferential direction (a detailed view is omitted). At the lower end of each protruding piece 90, a substantially horizontal shoulder surface 92 is formed. In a lower end part of the inner peripheral surface of the locking wall 82, a first locking ridge 94 is disposed which extends continuously in the circumferential direction and protrudes inwardly in the radial direction. Below the first locking ridge 94 on the inner peripheral surface of the locking wall 82, a first circumferential locking means 96 is disposed. Six of the first circumferential locking means 96 are arranged at equal angular intervals in the circumferential direction, although an illustration of this configuration is omitted, and each of the first circumferential locking means 96 collaborates with each of the first circumferential locked means 32 arranged in the lid body 6. That is, when the outer lid 6 is rotated clockwise relative to the lid body 4, the first circumferential locking means 96 provided in the outer lid 6 elastically climbs over the first circumferential locked means 32 provided in the lid body 4. When the outer lid 6 is rotated counterclockwise relative to the lid body 4, on the other hand, the first circumferential locking means 96 provided in the outer lid 6 is restrained by the first circumferential locked means 32 provided in the lid body 4.

In a lower end part of the skirt wall 78, a breakable line 98 extending in the circumferential direction is formed, and the skirt wall 78 is demarcated into a main portion 78*a* above the breakable line 98 and a tamper-evident bottom portion 78*b* below the breakable line 98. As viewed in the axial direction, the breakable line 98 is preferably located at the same height as, or below, the lower end of the suspending wall 80. On the outer peripheral surface of the main portion 78*a* in the skirt wall 78, knurls (irregularities) 100 are formed for preventing the slippage of fingers being hooked. In an upper end part of the inner peripheral surface of the tamper-evident bottom portion 78*b*, a second locking ridge 102 is disposed which extends continuously in the circumferential direction and protrudes inwardly in the radial direction. In a lower end part of the inner peripheral surface of the tamper-evident bottom portion 78*b*, a second circumferential locking means 104 is disposed. A multiplicity of the second circumferential locking means 104 are arranged at equal angular intervals in the circumferential direction, although an illustration of this configuration is omitted, and each of the second circumferential locking means 104 collaborates with each of the second circumferential locked means 42 arranged in the lid body 6. That is, when the outer lid 6 is rotated clockwise relative to the lid body 4, the second circumferential locking means 104 provided in the outer lid 6 elastically climbs over the second circumferential locked means 42 provided in the lid body 4. When the outer lid 6 is rotated counterclockwise relative to the lid body 4, on the other hand, the second circumferential locking means 104 provided in the outer lid 6 is restrained by the second circumferential locked means 42 provided in the lid body 4.

The lid body 4 and the outer lid 6 described above are combined together by rotating the outer lid 6 clockwise, as viewed from above, with respect to the lid body 4, with the outer lid 6 being fitted to the lid body 4, to screw the internal thread 88 of the outer lid 6 with the external thread 26 of the lid body 4. This procedure is performed, with a predetermined jig acting on the ribs 33 and ratchet portion 38 of the lid body 4 to restrain the rotation of the lid body 4 relative to the outer lid 6, as stated earlier. When the outer lid 6 is rotated in the above-mentioned direction with respect to the lid body 4 to lower the outer lid 6 relative to the lid body 4, the first circumferential locking means 96 in the outer lid 6 elastically climbs over the first circumferential locked means 32 in the lid body 4, and the second circumferential locking means 104 in the outer lid 6 also elastically climbs over the second circumferential locked means 42 in the lid body 4. Thus, the rotation of the outer lid 6 relative to the lid body 4 is not restrained by the collaboration between the first circumferential locking means 96 and the first circumferential locked means 32, and the collaboration between the second circumferential locking means 104 and the second circumferential locked means 42. When the internal thread 88 of the outer lid 6 is screwed to the external thread 26 of the lid body 4 to combine the lid body 4 and the outer lid 6, moreover, the first locking ridge 94 disposed on the locking wall 82 of the outer lid 6 elastically climbs over the first locked ridge 30 disposed on the locked wall 24 of the lid body 4 and gets locked below it. Furthermore, the second locking ridge 102 disposed on the skirt wall 78 of the outer lid 6 elastically climbs over the second locked ridge 40 disposed on the suspending wall 34 of the lid body 4 and gets locked below it. The outer lid 6 is rotated relative to the lid body 4 until the shoulder surface 92 formed in the suspending wall 80 contacts the upper surface of the cylindrical wall 20 of the lid body 4, whereby the outer lid 6 is mounted on the lid body 4. In the state of the outer lid 6 being mounted on the lid body 4, the outer peripheral surface of the auxiliary sealing piece 86 of the outer lid 6 is in intimate contact with the inner peripheral surface of the upper end part of the pouring wall 22 of the lid body 4, as shown in FIG. 1.

The container lid 2 combined as above is mounted on a mouth-neck section 106 of a container, which is indicated by dashed double-dotted lines in FIG. 1, by lowering it forcibly until it enters a state as shown in FIG. 1, with respect to the mouth-neck section 106 of the container. By so doing, the locking means 48 formed on the inner peripheral surface of the side wall 10 in the lid body 4 elastically climbs over a locking jaw portion 108 formed on the outer peripheral surface of the mouth-neck section 106 and gets locked thereto, whereby the lid body 4 is secured to the mouth-neck section 106. Besides, the sealing wall 36 of the lid body 4 is advanced into the mouth-neck section 106, thereby sealing the mouth-neck section 106.

In consuming the contents of the container, fingers are hooked over the skirt wall 78 of the outer lid 6, and the outer lid 6 mounted on the lid body 4 is rotated counterclockwise as viewed from above. When the outer lid 6 is rotated in this direction with respect to the lid body 4, the threaded engagement (screwing-together) between the internal thread 88 formed in the suspending wall 80 of the outer lid 6 and the external thread 26 formed in the lid body 4 is released to raise the outer lid 6 relative to the lid body 4. At this time, the first locking ridge 94 disposed on the locking wall 82 of the outer lid 6 is locked to the first locked ridge 30 disposed on the locked wall 24 of the lid body 4 to restrain the ascent of the outer lid 6 relative to the lid body 4, and the first circumferential locking means 96 disposed on the locking wall 82 of the outer lid 6 is locked to the first circumferential locked means 32 disposed on the locked wall 24 of the lid body 4 to restrain the rotation of the outer lid 6 relative to the lid body 4. When the outer lid 6 is further rotated in the above direction relative to the lid body 4, therefore, stress is transmitted to, and concentrated in, the breakable line 16 provided in the closing wall 14 via the first locking ridge 94/first locked ridge 30 and the first circumferential locking means 96/first circumferential locked means 32. Under such a force, the breakable line 16 is broken to form a discharge opening. After the breakable line 16 is broken to form the discharge opening in the closing wall 14 of the lid body 4, the outer lid 6 is further rotated in the above direction relative to the lid body 4. As a result, the discharge opening formation region 18 is separated from the other part of the closing wall 14, and the discharge opening formation region 18 is raised, together with the outer lid 6, with respect to the lid body 4. When the discharge opening formation region 18 is removed from the other part of the closing wall 14, the sealing piece 44 is elastically bent and moved to a position above the other part.

When the outer lid 6 is rotated in the above direction with respect to the lid body 4 and raised relative to the lid body 4, moreover, the second locking ridge 102 disposed on the skirt wall 78 of the outer lid 6 is locked to the second locked ridge 40 disposed on the suspending wall 34 of the lid body 4 to restrain the ascent of the outer lid 6 relative to the lid body 4, and the second circumferential locking means 104 disposed on the skirt wall 78 of the outer lid 6 is locked to the second circumferential locked means 42 disposed on the suspending wall 34 of the lid body 4 to restrain the rotation of the outer lid 6 relative to the lid body 4. When the outer lid 6 is further rotated in the above direction relative to the lid body 4, therefore, stress is transmitted to, and concentrated in, the breakable line 98 provided in the skirt wall 78 via the second locking ridge 102/second locked ridge 40 and the second circumferential locking means 104/second circumferential locked means 42. Under such a force, the breakable line 98 is broken. Afterwards, the main portion 78*a* is moved upward in accordance with the rotation and detached from the lid body 4, with the tamper-evident bottom portion 78*b* being left behind. Hence, the discharge opening created in the closing wall 14 of the lid body 4 is exposed, and the contents of the container can be discharged from the discharge opening.

After the discharge of the required amount of the contents is completed, the outer lid 6 is fitted onto the lid body 4, and then rotated clockwise as viewed from above to screw the internal thread 88 formed on the inner peripheral surface of the suspending wall 80 of the outer lid 6 to the external thread 26 formed on the outer peripheral surface of the cylindrical wall 20 of the lid body 4 and lower the outer lid 6 relative to the lid body 4. When the outer lid 6 is rotated in the above direction relative to the lid body 4, and thereby lowered relative to the lid body 4, although an illustration of this configuration is omitted, the sealing piece 44 contacts the upper surface of the aforementioned other part of the closing wall 14 to inhibit the downward movement of the discharge opening formation region 18 and close the discharge opening created in the closing wall 14. In this manner, the outer lid 6 removed from the lid body 4 is mounted again on the lid body 4.

After the contents of the container are utterly consumed, the whole of the container lid 2 is removed from the mouth-neck section 106 of the container for so-called assorted collection of wastes. On this occasion, the main portion 78*a* of the outer lid 6 is detached from the lid body 4 beforehand (if desired, the tamper-evident bottom portion 78*b* may also be detached from the lid body 4 beforehand by a suitable means). In this state, the pinching portion 67 defined in the surrounding wall 12 at the counterclockwise upstream end part of the surrounding wall separation region 50 is gripped, and urged upwardly or radially outwardly, whereby the breakable connection piece 64 is broken. Then, the pinching portion 67 is urged radially outwardly or counterclockwise. At this time, in the surrounding wall separation region 50, the breakable connecting pieces 58 and the breakable thin-walled connecting wall 59 connecting the surrounding wall 12 and side wall 10 together are broken, with the result that the surrounding wall 12 is spaced from the side wall 10 and moved radially outwardly. In the transition region 52, the breakable thin-walled connection wall 68 connecting the main portion 8 and the side wall 10 together in such a region is broken, and the breakable thin-walled line 70 formed in the side wall 10 and having at least a part thereof extending obliquely downwardly counterclockwise is broken. The breakage of the breakable thin-walled line 70 will be described in further detail by reference to FIG. 14. In the transition region 52, radially outward stress is initially applied to the counterclockwise upstream end of the thin-walled portion 72. Since, in this condition, the first straight edge 74*a* of the region 74 where the side wall 10 and the surrounding wall 12 are firmly connected together is located in a counterclockwise upstream end part of the thin-walled portion 72, stress is concentrated in the part between the first straight edge 74*a* and the counterclockwise upstream edge of the thin-walled portion 72 as viewed counterclockwise (namely, in the upper end portion 70*a* of the breakable thin-walled line 70), and such a part is broken. Then, the thin-walled portion 72 is broken (that is, the inclined main portion 70*b* of the breakable thin-walled line 70 is broken) along the inclined edge 74*b* of the region 74. On this occasion, a shearing force is satisfactorily exerted between the region 74 and the thin-walled portion 72, because the region 74 with relatively high rigidity includes a part of the thin-walled portion 72 with relatively low rigidity. Thus, the breakage of the inclined main portion 70*b* of the breakable thin-walled line 70 is smoothly carried out. As a result, the side wall 10 is broken in the up-and-down direction. On the side counterclockwise downstream of the breakable line 70, the side wall 10 and the surrounding wall 12 are firmly connected together, so that the side wall 10 is moved, together with the surrounding wall 12, outwardly in the radial direction. Then, in the side wall separation region 54, the breakable thin-walled connection wall 68 connecting the main portion 8 and the side wall 10 together in a manner continued from the transition region 52 is broken, the side wall 10 is moved radially outwardly along with the surrounding wall 12, and the locking of the locking means 48 formed in the lid body 4 to the locking jaw portion 108 formed in the mouth-neck section 106 of the container is gradually released. The breakage of the breakable thin-walled connection wall 68 ends when the non-separation region 56 is reached. After the breakage of the breakable thin-walled connection wall 68 is completed, the locking of the locking means 48 to the mouth-neck section 106 of the container is sufficiently weakened. Hence, the surrounding wall 12 in the non-separation region 56 is used as an axis, and the surrounding wall 12 in the other regions is urged upward about this axis. By so doing, the entire lid body 4 can be removed sufficiently easily from the mouth-neck section 106 of the container.

With the container lid 2 of the present invention, at least a part of the breakable thin-walled line 70 formed in the side wall 10 in the transition region 52 extends obliquely downwardly in the counterclockwise direction. Thus, subsequently to the breakage of the breakable thin-walled line 70 in the transition region 52, the breakage of the breakable thin-walled connection wall 68 in the side wall separation region 54 can be started sufficiently smoothly. Consequently, the container lid 2 can be removed sufficiently easily from the mouth-neck section 106 of the container.

EXPLANATIONS OF LETTERS OR NUMERALS

2: Container lid
4: Lid body
6: Outer lid
8: Main portion
10: Side wall
12: Surrounding wall
50: Surrounding wall separation region
52: Transition region
54: Side wall separation region
56: Non-separation region
68: Breakable thin-walled connection wall
70: Breakable line
70*a*: Upper end portion
70*b*: Inclined main portion
72: Thin-walled portion
74: Region
106: Mouth-neck section of container
108: Locking jaw portion

The invention claimed is:

1. A synthetic resin container lid having a lid body, and being configured such that the lid body includes a main portion for covering a top face of a mouth-neck section of a container, a cylindrical side wall suspending from the main portion, and a cylindrical surrounding wall surrounding the side wall, locking means extending in a circumferential direction is formed on an inner peripheral surface of the side wall, and the lid body is fitted onto the mouth-neck section of the container to engage the locking means with a locking jaw portion formed on an outer peripheral surface of the mouth-neck section of the container, whereby the lid body is mounted on the mouth-neck section of the container, wherein a surrounding wall separation region, a transition region, and a side wall separation region are disposed sequentially in the counterclockwise direction, as viewed from above the container lid, in the surrounding wall separation region, an upper end of the surrounding wall is connected to the side wall via a plurality of breakable connecting pieces arranged at intervals in the circumferential direction or via a breakable thin-walled connecting wall extending continuously in the circumferential direction and, at a counterclockwise upstream end of the surrounding wall separation region, a slit extending upwardly from a lower end of the surrounding wall is formed in the surrounding wall, in the transition region and the side wall separation region, an upper end of the side wall is connected to the main portion via a breakable thin-walled connection wall extending continuously in the circumferential direction, and in the transition region, a breakable thin-walled line at least a part of which extends obliquely downwardly in the counterclockwise direction is formed in the side wall, and the side wall and the surrounding wall are firmly connected together on a side counterclockwise downstream of the breakable thin-walled line.

2. The synthetic resin container lid according to claim 1, wherein the breakable thin-walled line is composed of an upper end portion extending vertically downwardly from the upper end of the side wall, and an inclined main portion following the upper end portion and extending obliquely downwardly to a lower end of the side wall in the counterclockwise direction.

3. The synthetic resin container lid according to claim 2, wherein the inclined main portion has an inclination angle of 10 to 80 degrees with respect to a vertical.

4. The synthetic resin container lid according to claim 1, wherein the surrounding wall separation region is present over an angle of 20 to 180 degrees, the transition region is present over an angle of 10 to 45 degrees, and the side wall separation region is present over an angle of 90 to 270 degrees.

5. The synthetic resin container lid according to claim 1, wherein a non-separation region present over an angle of 45 to 180 degrees is present between the side wall separation region and the surrounding wall separation region.

6. The synthetic resin container lid according to claim 1, wherein a counterclockwise upstream edge of the surrounding wall on a side downstream of the slit in the counterclockwise direction is connected via a breakable connection piece to a counterclockwise downstream edge of the surrounding wall on a side counterclockwise upstream of the slit, or to the side wall.

7. The synthetic resin container lid according to claim 1, wherein in the transition region, a thin-walled portion, which is defined by locally increasing an inner diameter of the side wall and which extends obliquely downwardly in the counterclockwise direction, is formed in the side wall, a region where the side wall and the surrounding wall are firmly connected together includes a part of the thin-walled portion, and the breakable thin-walled line is defined by a part in the thin-walled portion where the side wall and the surrounding wall are not connected together.

8. The synthetic resin container lid according to claim 1, wherein the breakable thin-walled connection wall which connects the main portion and the side wall together in the transition region and the side wall separation region is defined by locally decreasing an outer diameter of a cylindrical connecting portion.

9. The synthetic resin container lid according to claim 1, wherein a discharge opening formation region demarcated by a breakable line is defined in the main portion.

10. The synthetic resin container lid according to claim 1, wherein a cylindrical wall having an external thread formed on a cylindrical outer peripheral surface thereof is disposed in the main portion, and an outer lid having a top panel wall and a cylindrical suspending wall, which suspends from the top panel wall and has an internal thread formed on an inner peripheral surface thereof, is removably mounted on the lid body by screwing the internal thread to the external thread.

* * * * *